United States Patent [19]

Versteeg

[11] 4,191,247

[45] Mar. 4, 1980

[54] HEAT EXCHANGERS

[75] Inventor: Jacobus C. Versteeg, Teteringen, Netherlands

[73] Assignee: B.V. Machinefabriek Breda v/h Backer & Rueb, Breda, Netherlands

[21] Appl. No.: 801,067

[22] Filed: May 27, 1977

[51] Int. Cl.[2] ..... F28F 9/02

[52] U.S. Cl. ..... 165/158

[58] Field of Search ..... 165/142, 4, 5, 157, 165/158; 122/32, 34, 81–83

[56] References Cited

U.S. PATENT DOCUMENTS

| | | | |
|---|---|---|---|
| 2,475,025 | 7/1949 | Huff | 165/142 |
| 2,973,749 | 3/1961 | Huet | 122/32 |
| 3,227,142 | 1/1966 | Bell et al. | 122/34 |
| 3,650,322 | 3/1972 | Munnik | 165/83 X |
| 3,666,423 | 5/1972 | Muengor | 165/157 |

FOREIGN PATENT DOCUMENTS

| | | | |
|---|---|---|---|
| 649518 | 11/1962 | Italy | 165/167 |
| 647645 | 12/1920 | United Kingdom | 165/157 |

*Primary Examiner*—Carroll B. Dority, Jr.
*Assistant Examiner*—Theophil W. Streule, Jr.
*Attorney, Agent, or Firm*—William P. Keegan

[57] ABSTRACT

This invention relates to a heat exchanger in which a medium flowing from a distribution header to a collection header is fed to the tube bundle through a plurality of pipes and subheaders and then gathered from the tube bundle into the collection header through a second plurality of subheaders and pipes. The subheaders are thin-walled, flexible, box-like members that can accommodate the expansions and contractions of the tubes in the tube bundle.

3 Claims, 6 Drawing Figures

FIG.1
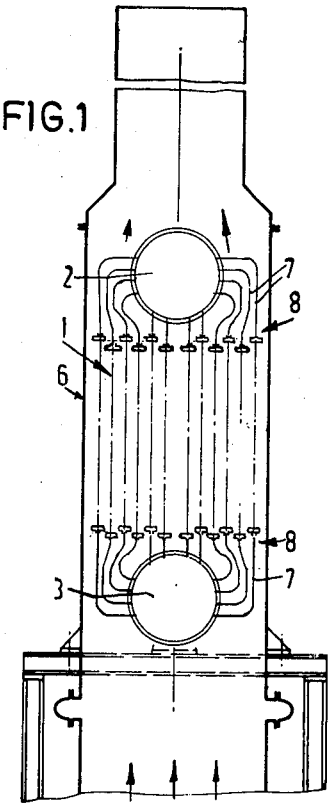
FIG.2
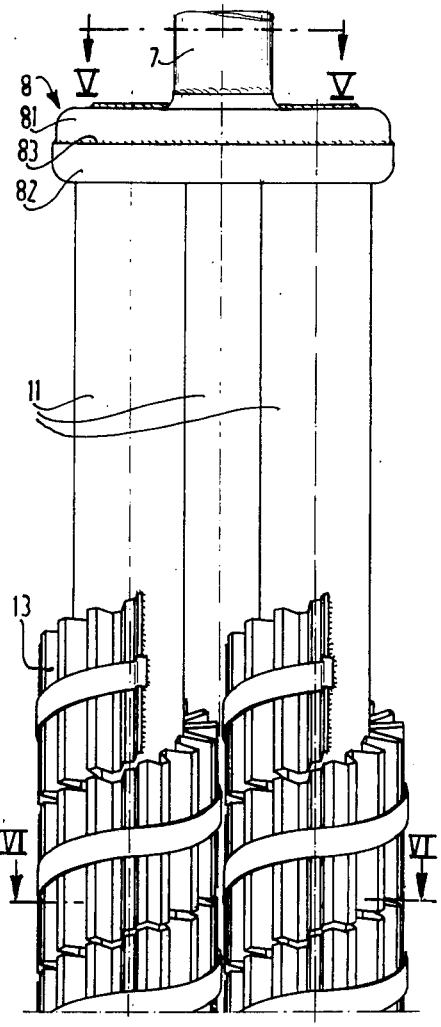
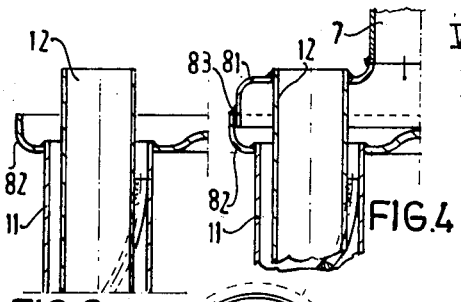
FIG.4
FIG.3
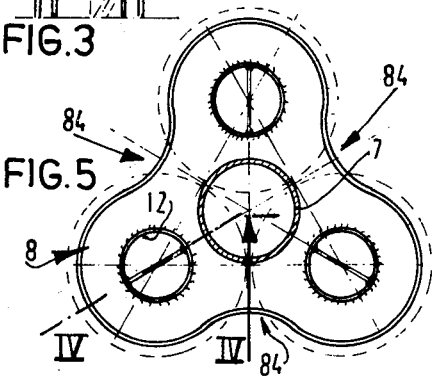
FIG.5
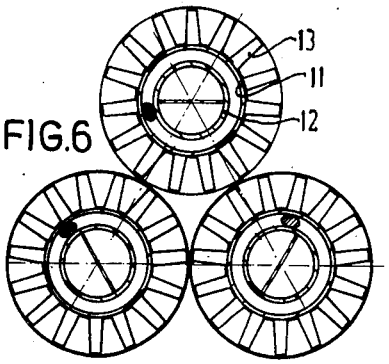
FIG.6

HEAT EXCHANGERS

The invention relates to a heat exchanger in which a tube bundle, comprising a plurality of groups of tubes, is connected to a distribution header and to a collection header by a plurality of distribution units and collection units, one of each for each group of tubes, which distribution units stepwise divide the medium from the distribution header uniformly among the tubes of the tube bundle and which collection units gather the medium from the tubes stepwise into the collection header, and in which the distribution and collection units comprise thin-walled flexible boxes.

An object of the invention is to provide an improved heat exchanger of the type described in U.S. patent application Ser. No. 640,765 (now continued in application Ser. No. 830,311), assigned to the assignee of the present invention, now abandoned. It deals particularly with the thin-walled, box-shaped elements which form part of the distribution and collection units of the heat exchanger. In the heat exchanger disclosed in said application the box-shaped distribution and collection elements are directly connected to the distribution and collecting headers respectively. As a result, these box-shaped elements can be mounted only with difficulty in large size heat exchangers.

Another object of the invention is to provide an improved heat exchanger while maintaining the advantages disclosed in said application Ser. No. 640,765, now abandoned, that is to say, while maintaining a comparatively light-weight, flexible structure which is capable of readily adjusting to operational stresses produced by high temperature variations.

In carrying out the invention, there is provided a distribution unit and a collection unit for each group of tubes in the tube bundle, each unit comprising a suitably shaped pipe connected at one end directly to the distribution or collection header, respectively, and a secondary header, formed of a thin-walled, flexible, box-like element, connected to the other end of the pipe and to the tubes in a group of tubes. The secondary header, that is, the box-shaped element is preferably constructed from two opposite, cup-shaped portions, whose edges are joined in a gas-tight manner.

Moreover, with a view to simple assembly of the heat exchanger the ends of the pipes connected to the collection and distribution headers (at least those pipes located further outwards with respect to the tube bundle) are directed normally to the plane of symmetry of the heat exchanger. Thus, a group of tubes of the tube bundle can first be fastened to the pipes and secondary headers forming a distribution unit and a collection unit, after which this entire assembly can readily be connected to the collection and distribution headers respectively by inserting the ends of the pipes laterally into previously drilled holes in the headers and welding the same.

Features and advantages of the invention may be gained from the foregoing and from the description of a preferred embodiment thereof which follows.

In the drawing:

FIG. 1 is a schematic cross-sectional view of a heat exchanger embodying the invention;

FIG. 2 shows a detail of the second distribution stage between a pipe and the tubings;

FIG. 3 is a cross-sectional view in detail of the end of a tubing connected to the lower half of a box-shaped element of FIG. 2;

FIG. 4 is a cross-sectional view, taken on line IV—IV of FIG. 5, showing, in detail, a completed box-shaped element connected to a tube and to a pipe;

FIG. 5 is a plan view, partly in section, taken on the line V—V in FIG. 2; and

FIG. 6 is a sectional view taken on the line VI—VI in FIG. 2

In the embodiment to be described, the heat exchanger comprises a tube bundle 1 connected to a distribution header 2 and a collection header 3, respectively. The tubes in bundle 1 conduct one medium from the distribution header 2 towards the collection header 3, whereas the other medium is guided around the tube bundle 1 by an envelope 6 surrounding the same. The other medium flows, as shown in FIG. 1, from bottom to top in the direction of the arrows so that heat exchange takes place between the two media in counterflow.

One medium is distributed from the distribution header 2 stepwise into smaller distribution streams before it reaches the tubes of bundle 1. Similarly, these distribution streams are collected stepwise into a main stream entering the collection header 3. For this distribution and collection, a plurality of pipes 7 are connected to the headers, and each pipe, in turn, is connected to the elements 8 which are finally connected to a group of tubes in bundle 1. In FIG. 1, pipes 7 and tube bundle are indicated only by lines.

FIGS. 2, 3, 4 and 5 show the element 8 in detail. The element, pr secondary header, 8 mainly comprises at flat box formed by two cup-shaped portions 81 and 82 (see FIG. 3 and 4), whose edges have to be joined at 83 in a gas-tight manner. In the embodiment shown, this is obtained by welding. In the top wall of the upper cup-shaped portion 81, the pipe 7 is centrally connected so that it opens out in the hollow cavity formed by two cup-shaped portions 81 and 82.

In the heat exchanger only a single-walled tube is used in the tube bundle 1, it may be compared with the outermost tube 11 in FIG. 3 and 4, which tube is secured to the lower cup-shaped portion 82 of the element 8 so that it opens out in the hollow cavity of the element 8. From the drawing it will be apparent that three tubes of the tube bundle 1 are fastened to the element 8, so that the second stage divides a stream from the pipe 7 into three partial streams in the tubes 11 or unites the partial streams from the tubes 11 to a single main stream in the pipe 7.

In the embodiment shown, a double-walled tube is used for each tube in tube bundle 1 rather than a single-walled tube. For this purpose the outer tube 11 include a coaxial inner tube 12, through which flows the other medium guided by the envelope 6. The inner tube 12 is larger than the outer tube 11 so that it extends through element 8, that is to say, across the cup-shaped element 81 (see FIG. 4). Thus, one medium flows from distribution header 2 to collection header 3 through pipes 7, elements 8, and the annular spaces between tubes 11 and 12, while the second medium flows through tubes 12 and around tubes 11, elements 8, and pipes 7.

FIGS. 3 and 4 illustrate the easy mode of assembling the heat exchanger, which is facilitated by the element 8. First the cup-shaped portion 82 is welded to the outer tube 11 of the double-walled tube as is shown in FIG. 3. Subsequently the cup-shaped portion 81 has welded to it the inner tube 12, after which the two cup-shaped portions 81 and 82 are joined to form a single element 8 by welding the edge parts at 83. Finally the pipe 7 can be welded in the middle of the cup-shaped portion 81.

The plan view of FIG. 5 shows that the element 8 essentially has a triangular shape. The sides of the triangle are constricted at 84 to an extent such that as far as possible the circumference of the outer tube 11 with the cooling vanes 13 secured thereto (see FIG. 2) is matched. In this way the other medium flowing along the cooling vanes 13 is retained as little as possible by the element 8, as a result of which the overall resistance in a heat exchanger is lower. Nevertheless owing to this structure the relative flexibility of the tubes is ensured, since the element 8 has a thin wall and the top and bottom walls of the cup-shaped portions 81 and 82 are capable of moving relatively to one another.

Having further regard to easy mounting operations, the ends of the pipes 7 joining the distribution and collection headers respectively are arranged at right angles to the plane of symmetry (see FIG. 1). This at least applies to the pipes connected to the outer tubes of the tube bundle 1. It is now possible to first connect the inner pipes 7 to the headers 2 and 3, after which the outermost pipes 7, which have previously been united via the elements 8 with the groups of tubes can be readily fastened to the headers 2 and 3 by sliding the unit laterally at right angles to the plane of symmetry inwardly and by welding it to the headers.

Within the scope of the invention other dispositions of the various elements are possible. The pipes 7 may co-operate with more than three tubes, the shape of the distribution element 8 being adapted thereto. Furthermore the pipes 7 may be proportioned so that the elements 8 are located at the same level, and not alternate with one another, as shown in FIG. 1.

What is claimed is:

1. A heat exchanger comprising a distribution header, a collection header, a plurality of groups of tubes for conducting a first medium from said distribution header to said collection header, each tube being provided with an inner tubular member for forming an annular space between the tubular member and the tube, distribution means connected to said distribution header and to each group of tubes for dividing the first medium into a plurality of streams, collection means connected to each group of tubes and to said collection header for combining streams of the first medium in said collection header, each distribution means and each collection means including a pipe connected to said distribution header and to said collection header, respectively, and a secondary header connecting a pipe to the tubes in a group of tubes, and an envelope surrounding said plurality of groups of tubes, said distribution and said collection means for guiding a second medium around said elements, characterized in that each secondary header comprises a pair of oppositely facing cup-shaped thin-walled flexible members, the edges of which are joined in a gas tight manner to form a header having spaced apart substantially parallel first and second walls, and in that a pipe is connected to said first wall, the tubes forming a group of tubes are connected to said second wall, and the tubular members provided in the tubes forming a group of tubes extend through said secondary header and are connected to said first wall, whereby the first medium flows from the distribution header through the pipes, secondary headers and the annular spaces between the tubes and their associated tubular members, and the second medium flows through the tubular members and around the outside surfaces of the tubes, secondary headers, and pipes of said distribution and collection means.

2. A heat exchanger according to claim 1 characterized in that said parallel walls of said secondary header are substantially triangularly shaped, and that a group of tubes comprises three tubes each of which is connected in a corner part of said other of said walls, the pipe is centrally connected to said one of said walls, and the inner tubular members of the tubes are connected to the corner parts of said one of said walls.

3. A heat exchanger according to claim 2 characterized in that the side walls of said secondary header are curved inwardly.

* * * * *